United States Patent [19]

Olson

[11] 4,244,662

[45] Jan. 13, 1981

[54] SNOW GROOMER

[76] Inventor: James L. Olson, 16823 Judicial Rd., Lakeville, Minn. 55044

[21] Appl. No.: 46,423

[22] Filed: Jun. 7, 1979

[51] Int. Cl.[3] ..... E01C 19/22

[52] U.S. Cl. ..... 404/118; 37/35; 172/780; 172/787

[58] Field of Search ..... 404/118, 101, 75; 37/29, 30, 35; 172/779, 780, 787, 795

[56] References Cited

U.S. PATENT DOCUMENTS

| | | | |
|---|---|---|---|
| 1,802,087 | 4/1931 | McConnaughay | 404/101 X |
| 1,833,878 | 11/1931 | Adams | 404/118 X |
| 1,941,833 | 1/1934 | Gustafson | 404/118 X |
| 1,995,267 | 3/1935 | Pease | 404/101 |
| 2,592,960 | 4/1952 | Schulze | 404/119 |
| 2,962,946 | 12/1960 | Neff | 404/101 |
| 3,398,663 | 8/1968 | Matich | 404/118 X |
| 3,496,843 | 2/1970 | Wallingford | 404/75 |

*Primary Examiner*—Nile C. Byers, Jr.
*Attorney, Agent, or Firm*—Jacobson and Johnson

[57] ABSTRACT

A snow grooming device for leveling a snowmobile trail comprising a frame having retractable wheels for transporting the snow grooming device and a set of angled blades which direct the snow back and forth across the trail to a leveler bar that directs the snow to a compacter attachment.

9 Claims, 7 Drawing Figures

SNOW GROOMER

BACKGROUND OF THE INVENTION

1. Field of the Invention

This invention relates generally to snow grooming vehicles and, more specifically, to improvements to an apparatus for grooming snowmobile trails.

2. Description of the Prior Art

The concept of apparatus for leveling snow is well known in the art. The prior art apparatus generally show some type of member for engaging or directing snow from one location to another. Typical of the prior art patents on snow grooming devices are as follows:

The Cote U.S. Pat. No. 3,884,498 shows a flexible curved drag flap for attachment to the rear of a snowmobile. The drag flap attaches to the rear of a snowmobile through a flexible member that holds one edge of the flap in contact with the snowmobile trail.

The Brown U.S. Pat. No. 3,815,688 shows a snow grader having a support frame with a plurality of baffles extending crosswise across the frame at an angle of 90° to the direction of travel of the grader.

The Maxey U.S. Pat. No. 4,056,328 shows a snow groomer for snowmobile trails which has leveler blades, a scoop roller and a floating pan which coact to work the snow and level the trail.

The Boisse, et al U.S. Pat. No. 3,878,900 shows a trail grooming apparatus having a two part frame with the rear part having a cutting blade that extends forward to cut snow and a large snow compactor bar which is located behind the cutting blade. The front part contains skis which can control the depth of cut.

The Ratcliffe U.S. Pat. No. 3,576,214 shows a trailer type snowmobile trail smoothing device having a plurality of scraper blades which are vertically adjustable. The frame is foldable to permit convenient storage or transportation.

The White U.S. Pat. No. 3,739,859 shows still another embodiment of the light-weight snow leveler for snowmobile trails. The White device uses a set of discs to cut up the snow and a set of snow shifting members to level the snow after the snow has been cut by the discs.

The Esquilat patent U.S. Pat. No. 4,058,913 shows a light-weight trail groomer having a blade positioned forward of a set of skis which are used to vertically position scraper blade.

The Camp U.S. Pat. No. 3,872,931 shows a combination transporting device and trail grader which has a moldboard that extends from side to side of the carrier to knock down any moguls or bumps in the trail.

In addition to apparatus designed for snow groomers, there are other types of land levelers. One such device is shown in the Northon U.S. Pat. No. 1,329,543. Northon shows a horse-pulled frame having a set of blades which are positionably adjustable to level a road.

A further embodiment of a land leveler is shown in the Sprague U.S. Pat. No. 2,881,540. Sprague shows a device with wheels thereon for raising or lowering the leveler and a set of transverse blades for leveling the soil.

The Purdy U.S. Pat. No. 3,047,969 shows an alternate embodiment of a land leveler useable for preparing a seedbed. The Purdy device has a set of diagonally spaced grader blade members which extend substantially across the leveling device to direct the dirt to and fro in a leveling process. Purdy includes retractable wheels to raise or lower the frame.

Of the prior art grooming devices, the prior art devices are either complicated, light-weight, or inadequate for use on snowmobile trails in wooded areas. The present invention provides improved snow trail groomer which can effectively level a trail through even the most difficult terrain.

BRIEF DESCRIPTION OF THE INVENTION

Briefly, the invention comprises a snow groomer apparatus for leveling moguls on snowmobile trails. The snow groomer comprises a rectangular frame having a set of snow cutting blades angled toward the center from opposite sides of the frame. The snow cutting blades cut off the moguls and direct the snow toward the center of the snow groomer where it contacts a leveler bar that holds and distributes the snow before the snow is compacted under a flat pan located at the rear of the snow groomer. The snow groomer includes a set of front wheels which are individually adjustable to control the depth of the snow cutting blades and a set of retractable rear wheels that are used to transport the snow groomer across roads.

DESCRIPTION OF THE PREFERRED EMBODIMENT

Figure 1:
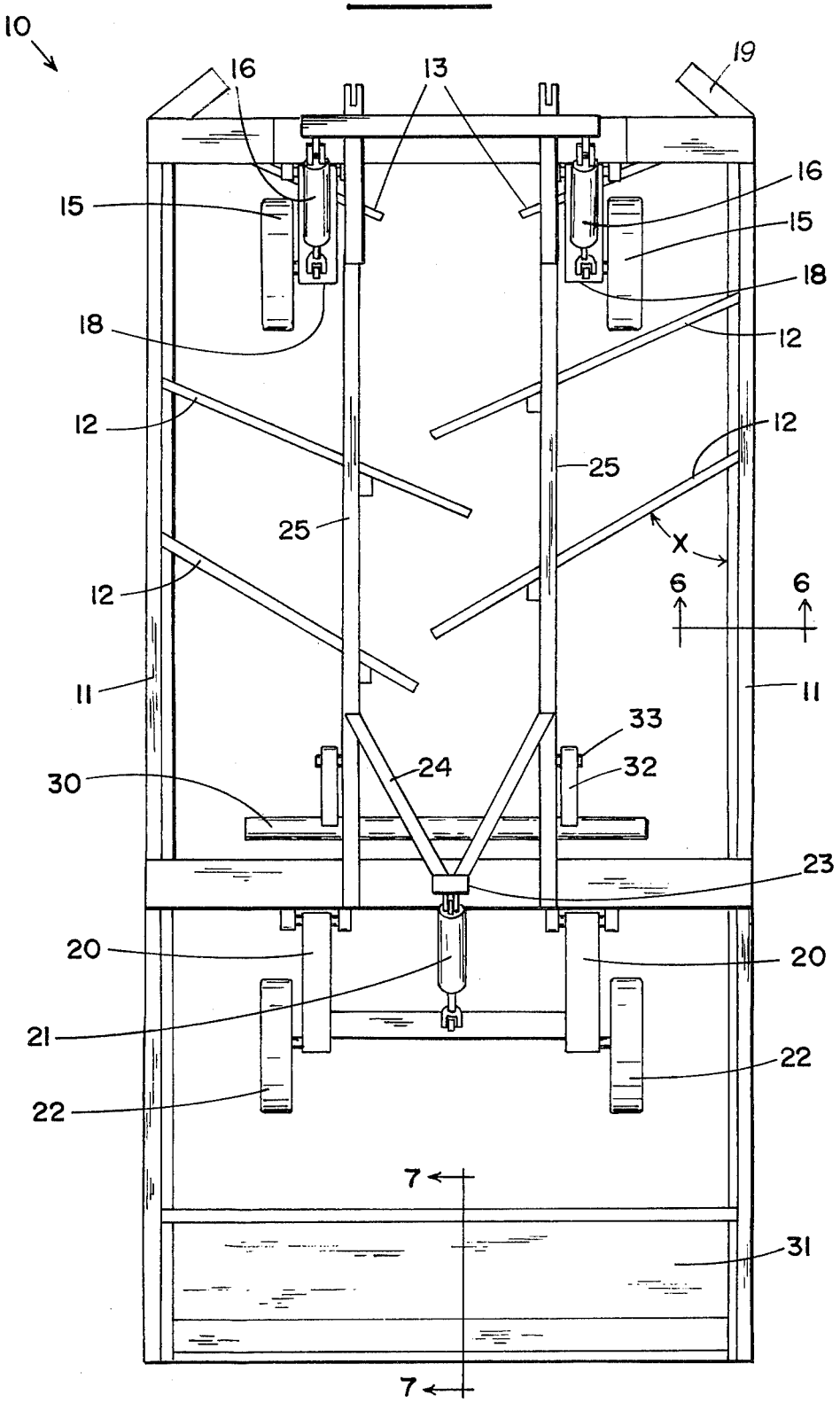
FIG. 1 is a top view of the snow groomer.

Referring to FIG. 1, reference numeral 10 generally designates my snow groomer comprising an outer rectangular frame 11 having two sets of snow cutting and leveling blades extending from side frame 11. A first set of snow cutting and leveling blades 13 are located on the front of frame 11 extend only partially to the center of groomer 10 whereas the second set of rearward snow cutting and leveling blades 12 extend past the center of the frame 11 to direct snow back and forth from blade to blade.

Figure 5:
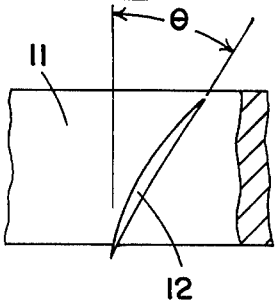
FIG. 5 is an end view of a cutting blade.

Blades 12 are located at an angle X with respect to frame 11. Typically, X is on the order of 70° or less. The purpose of front blades 13 is to form a smooth path in front of wheels 15, whereas rearward blades 12 perform the cutting and compacting. A reference to FIG. 5 shows an end view of blade 12 which is positioned with respect to the vertical. Note, blade 10 mounts at angle $\theta$ with respect to the vertical. The angle $\theta$ varies from a minimum of about 5° to a maximum of about 45°. However, for most operations, if $\theta$ is approximately 10° produces good results, i.e. the slight forward thrust of blade 12 provides a compacting action as well as a cutting action as blade 12 passes through the snow.

Figure 6:
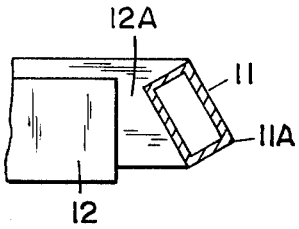
FIG. 6 is a section view of the frame.

Referring to FIG. 6, reference numeral 12 designates blade 12 fastened to side frame 11. Note, blade 12 is at a slightly lower depth than frame 11 and frame 11 has a rectangular cross section which is mounted diagonally with respect to the horizontal. This positioning allows member 11 to act as a runner as well as provides additional strength to frame 11. That is, should frame 11 hit a stump or tree, frame edge 11A is sufficiently strong so as to displace the groomer rather than permit buckling of frame 11. Similarly, the added strength in the horizontal direction provides protection against trail obstructions bending frame 11.

Located on front portion of frame 11 are a pair of wheels 15. Wheels 15 mount on frames 18 which are pivotally connected to frame 11 and to pressure cylinders 16. Cylinders 16 connect to a source of hydraulic fluid (not shown). Cylinders 16 connect to a common source of pressurized fluid to minimize the effect of holes or moguls in the path of the wheels of snow groomer 10. To control the depth of cutting by blades 12 and 13 one controls the pressure signal to front cylinders 16. In contrast, back wheels 20 which are controlled by a single pressure cylinder 21 are used only for elevating the rear portion of groomer from the ground during transportation of groomer 10 across roadways. FIG. 1 shows back wheel 22 connected to frame 11 by pivotally mounted arms 20 which can be raised or lowered by supplying a signal to pressure cylinder 21. A support frame 25 connects the front of frame 11 to the rear wheel support of frame 11.

Figure 7:
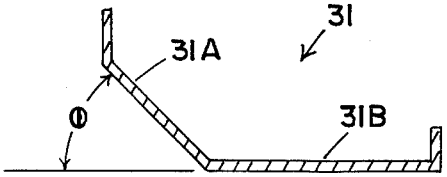
FIG. 7 is a section view of the snow compacting pan.

Located rearward of blade members 12 is a leveler bar 30 which mounts transverse to the direction of the trail being groomed. Leveler bar 30 extends across the center of the groomer 11. Leveler bar 30 comprises a round bar which diverts and directs the snow discharging from blades 12. Leveler bar 30 is positioned slightly higher than the cutting edge of blades 12. The high elevation of leveler bar 30 forces snow over, under, and around leveler bar. Typically, leveler bar may be cylindrical pipe which is positioned approximately two inches above the plane extending through the cutting edges of blades 12. As snow passes underneath leveler bar 30, a flat pan 31 compacts and levels the snow. FIG. 7 shows rear packing pan in section. Note, pan 31 contains an angled front section 31A which is located at an angle $\theta$ with respect to the horizontal. Front section 31A acts as a compactor and snow dispersal shield to direct loose snow under rear packing plate 31B. In operation, packing plate 31B is located at the same elevation as grader blades 12. Typically, $\theta$ may be about 45°.

Figure 3:
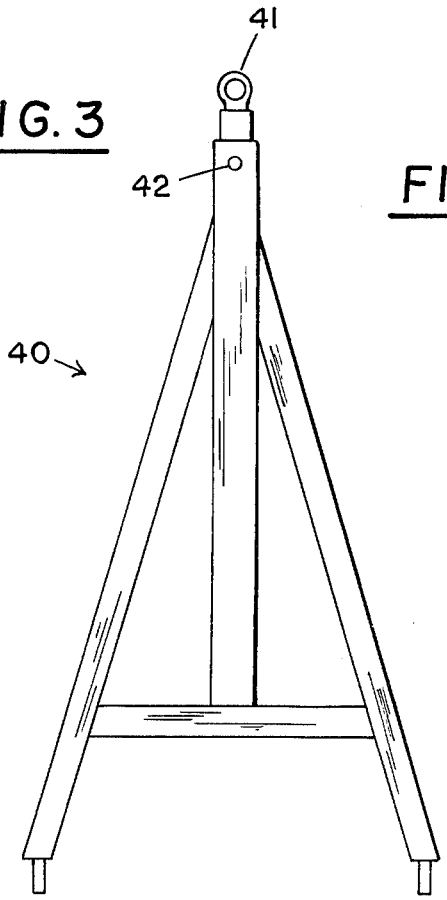
FIG. 3 is a top view of snow groomer hitch.
Figure 2:
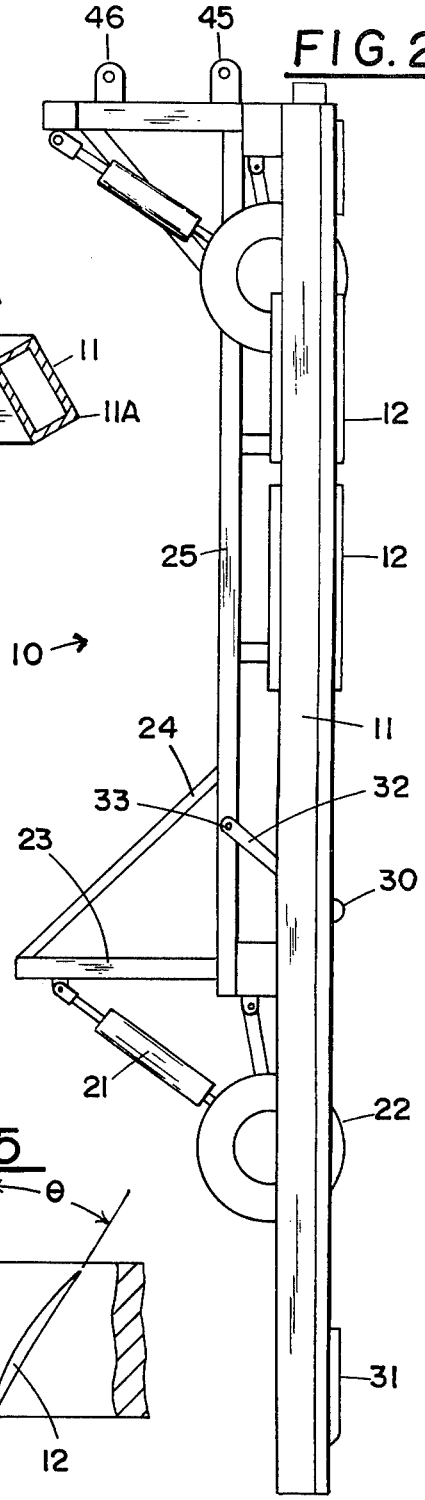
FIG. 2 is a side view of the snow groomer.
Figure 4:
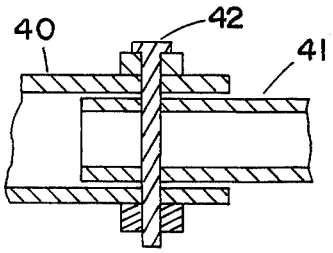
FIG. 4 is a sectional view of my break-away pin.

Referring to the FIG. 3, there is shown a hitch 40 having an eye 41 for attachment to a pulling vehicle such as a snow cat. Located in the central member of hitch 40 is a shear pin 42 which is shown in greater detail in FIG. 4. Shear pin 42 allows eye to separate from hitch 40 should an operator hit a stump or tree with groomer, i.e. pin 42 shears off preventing damage to the frame. FIG. 2 shows hitch 40 can be connected to a lower attachment 45 or an upper attachment 46. The point of attachment of hitch 40 to snow groomer depends on the elevation of the tow bar on the pulling vehicle.

Referring to FIG. 1, note, rear blade 12 does not extend across the center of groomer 10, instead rear blade 12 is about 6 to 8 inches short of the center line of the groomer. The purpose of shorter blade is to direct the snow to the center of the groomer so snow can be distributed evenly across the trail. Also located on front of frame 10 are a pair of tree bumpers 19 that prevent groomer 10 from foreward contact with any obstruction on the trail.

I claim:

1. A snow grooming device for leveling a snowmobile trail comprising:

a frame having a front section and a back section, said frame including a pair of outer sections forming a set of side members operable to function as a runner, said set of side members having sufficient strength to withstand an impact from an obstruction located along the side of a trail as said snow grooming device is pulled along a snowmobile trail with obstructions located therealong;

a set of retractable wheels connected to said frame; said retractable wheels located inside said set of side members to thereby prevent said set of retracting wheels from engaging an obstruction along the side of the trail, said set of retractable wheels operable to permit raising and lowering of said frame;

a plurality of cutting and compacting blades, each of said cutting and compacting blades connected to said frame, said plurality of cutting and compacting blades angled toward said back section of said frame so that snow displaced by said plurality of cutting and compacting blades is directed toward the back section of said frame, said cutting and compacting blades having a cutting edge for grooming snow;

at least one cutting and compacting blade extending inward from opposite sides of said frame, said cutting and compacting blades having sufficient length to direct snow over half way across said frame yet sufficiently short so as not to direct the snow outside of said frame, said plurality of cutting and compacting blades staggered to thereby coact to direct snow from said set of side members to the center of said groomer to thereby permit the snow to fill in holes in the trail with excess snow directed to a leveler in said groomer;

a leveler connected to said frame, said leveler located rearward of said plurality of cutting and compacting blades, said leveler operable to deflect and divert excess snow from said cutting and compacting blades over an extended area to thereby spread the snow within the confines of said frame to enable compacting of the spread snow; and a compactor operatively related to said frame for compacting the snow as it discharges from said leveler.

2. The invention of claim 1 wherein said blades have a forward angle with respect to a vertical of a minimum of 10°.

3. The invention of claim 2 wherein said blades comprise a set of at least four blades.

4. The invention of claim 3 wherein said frame comprises a beam having a box section, said beam positioned so an edge of said box section forms a runner for said frame.

5. The invention of claim 4 wherein said compactor includes a forward section for directing loose snow under said compactor.

6. The invention of claim 5 wherein said frame includes a positionable hitch, said positionable hitch having a shear pin therein that shears in response to excessive force on said positionable hitch to thereby protect said groomer from damage.

7. The invention of claim 6 wherein said leveler bar extends partially across said frame.

8. The invention of claim 7 including a set of forward blades for leveling the path in front of said wheels.

9. The invention of claim 8 including means to elevate said groomer for transportation across roadways.

* * * * *